US007742881B2

(12) United States Patent
Muralidharan et al.

(10) Patent No.: US 7,742,881 B2
(45) Date of Patent: Jun. 22, 2010

(54) SYSTEM AND METHOD FOR DETECTION OF ROTOR ECCENTRICITY BASELINE SHIFT

(75) Inventors: Vasanth Muralidharan, Chennai Tamil Nadu (IN); Abhay Sudhakarrao Kant, Dubai (AE); S. N. Arul Saravanapriyan, Bangalore Karnataka (IN); Mahalakshmi Balasubramaniam S B, Bangalore Karnataka (IN); Jitendra Kumar, Mableton, GA (US)

(73) Assignee: General Electric Company, Schenectady, NY (US)

( * ) Notice: Subject to any disclaimer, the term of this patent is extended or adjusted under 35 U.S.C. 154(b) by 365 days.

(21) Appl. No.: 11/832,755

(22) Filed: Aug. 2, 2007

(65) Prior Publication Data

US 2009/0037121 A1 Feb. 5, 2009

(51) Int. Cl.

| | |
|---|---|
| ***G01B 21/20*** | (2006.01) |
| ***G01B 21/00*** | (2006.01) |
| ***G06F 19/00*** | (2006.01) |

(52) U.S. Cl. ..... 702/33; 33/517; 73/460; 73/487; 73/865.8; 340/679; 340/686.3; 702/187; 702/189

(58) Field of Classification Search ..... 33/501, 33/501.02, 501.03, 517, 700, 710; 73/66, 73/460, 487, 865.8, 865.9; 340/500, 540, 340/679, 686.1, 686.3, 686.6; 702/1, 33, 702/34, 127, 187, 189

See application file for complete search history.

(56) References Cited

U.S. PATENT DOCUMENTS 2,883,255 A * 4/1959 Anderson ..... 346/34
3,270,281 A * 8/1966 Mandle ..... 368/118
4,057,754 A * 11/1977 Pattantyus-Abraham et al. ..... 324/207.25

FOREIGN PATENT DOCUMENTS

| | | |
|---|---|---|
| JP | 3-057901 | 3/1991 |
| JP | 4-269601 | 9/1992 |
| JP | 5-018739 | 1/1993 |
| JP | 6-241703 | 9/1994 |
| JP | 8-163841 | 6/1996 |
| JP | 10-061494 | 3/1998 |
| JP | 11-237238 | 8/1999 |
| JP | 2000-241282 | 9/2000 |
| JP | 2004-191326 | 7/2004 |

OTHER PUBLICATIONS

"Speedtronic Mark V Steam Turbine Control System", J. Kure-Jensen et al, GER-3687C, pp. 1-15, 1996.

* cited by examiner

*Primary Examiner*—Edward R Cosimano
(74) *Attorney, Agent, or Firm*—Nixon & Vanderhye P.C.

(57) ABSTRACT

A method to determine eccentricity of a rotor in a turbine including: collecting sensor data of rotor eccentricity for a plurality of startup operations; establishing a baseline eccentricity value using the sensor data corresponding to a selected startup operation; determining an eccentricity value using the filtered sensor data for each of a plurality of startup operations subsequent to the selected startup operation; determining a rotor eccentricity difference between the baseline eccentricity value and each of the eccentricity values for the plurality of startup operations subsequent to the selected startup operation, and reporting a rotor eccentricity condition based on the rotor eccentricity difference.

20 Claims, 4 Drawing Sheets

SYSTEM AND METHOD FOR DETECTION OF ROTOR ECCENTRICITY BASELINE SHIFT

BACKGROUND OF THE INVENTION

The present invention relates to steam turbines and, in particular, to monitoring eccentricity in the rotor of steam turbines.

The eccentricity of a rotor in a steam turbine is an indicator of the bowing of the rotor shaft and is generally indicative of the vibratory condition of the turbine during transient and steady state operations. The amount of eccentricity in a turbine rotor has a significant impact on the availability, reliability, performance and operational life of a turbine rotor.

Frequent steam turbine startups and shutdowns, which is common in combined steam turbine and gas turbine cycle units, tend to increase rotor eccentricity. An increase in eccentricity beyond a predetermined threshold limit indicates a permanent bow in the rotor. Excessive rotor bow typically results in rotor unbalance, which causes vibration of the rotor, and may lead to rubs between the rotating components and the stationary components of a steam turbine. Rubbing can degrade performance of a steam turbine and increase operating costs.

Current methods of monitoring eccentricity of a steam turbine involve displacement probe sensors mounted on the steam turbine and adjacent the rotor. The sensor data is stored in databases and manually downloaded to a computer for analysis. The probe sensor data is searched to select data associated with specific turbine events (e.g., shut-down, startup and/or low speed rotor operation). Calculations are performed on the selected data manually to obtain baseline eccentricity values and eccentricity changes from startup to startup. This conventional method is less difficult when the turbine for which baseline eccentricity calculations are performed has relatively few start/stop cycles, but becomes tedious when the turbine has many such cycles. Performing manual calculations for a large volume of displacement sensor data is extremely time consuming and susceptible to error.

BRIEF DESCRIPTION OF THE INVENTION

A method is disclosed to determine eccentricity of a rotor in a turbine including: collecting sensor data of rotor eccentricity for a plurality of startup operations; establishing a baseline eccentricity value using the sensor data corresponding to a selected startup operation; determining an eccentricity value using the filtered sensor data for each of a plurality of startup operations subsequent to the selected startup operation; determining a rotor eccentricity difference between the baseline eccentricity value and each of the eccentricity values for the plurality of startup operations subsequent to the selected startup operation, and reporting a rotor eccentricity condition based on the rotor eccentricity difference.

The disclosed method may include filtering the sensor data to select sensor data corresponding to startup operations and using only the selected sensor data to determine the eccentricity values. The method may also report a trend of the rotor eccentricity differences for a period of time of at least one year and reporting excessive changes in rotor eccentricity. Further, the method may exclude from the determination of the eccentricity value sensor data having a rate of change greater than a predetermined limit during a startup period. In addition, the method may compare a long term average of eccentricity values for a plurality of startup operations over a predetermined long period of time to a current average of eccentricity values for a predetermined number of most recent startup operations.

A method is also disclosed to determine eccentricity of a rotor in a turbine comprising: collecting sensor data of rotor eccentricity for a time period corresponding to a variety of turbine operations; filtering the sensor data to extract sensor data corresponding to turbine startup operations; establishing a baseline eccentricity value using the filtered sensor data corresponding to a selected startup operation; determining an eccentricity value using the filtered sensor data for each of a plurality of startup operations subsequent to the selected startup operation; determining a rotor eccentricity difference between the baseline eccentricity value and each of the eccentricity values for the plurality of startup operations subsequent to the selected startup operation, and reporting a rotor eccentricity condition based on the rotor eccentricity difference.

A system is disclosed to determine eccentricity of a rotor in a turbine comprising: a rotor eccentricity sensor monitoring rotor eccentricity and generating rotor eccentricity data; a computer system including: (i) a database storing the rotor eccentricity data for a period corresponding to a variety of turbine operations; (ii) a data filter extracting rotor eccentricity data corresponding to turbine startup operations from the rotor eccentricity data and generating filtered sensor data; (iii) an algorithm establishing a baseline eccentricity value using the filtered sensor data corresponding to a selected startup operation; an algorithm establishing an eccentricity value using the filtered sensor data for each of a plurality of startup operations subsequent to the selected startup operation; (iv) an algorithm determining a rotor eccentricity difference between the baseline eccentricity value and each of the eccentricity values for the plurality of startup operations subsequent to the selected startup operation, and (v) a report generator to issue reports of a rotor eccentricity condition based on the rotor eccentricity difference.

DETAILED DESCRIPTION OF THE INVENTION

Figure 1:
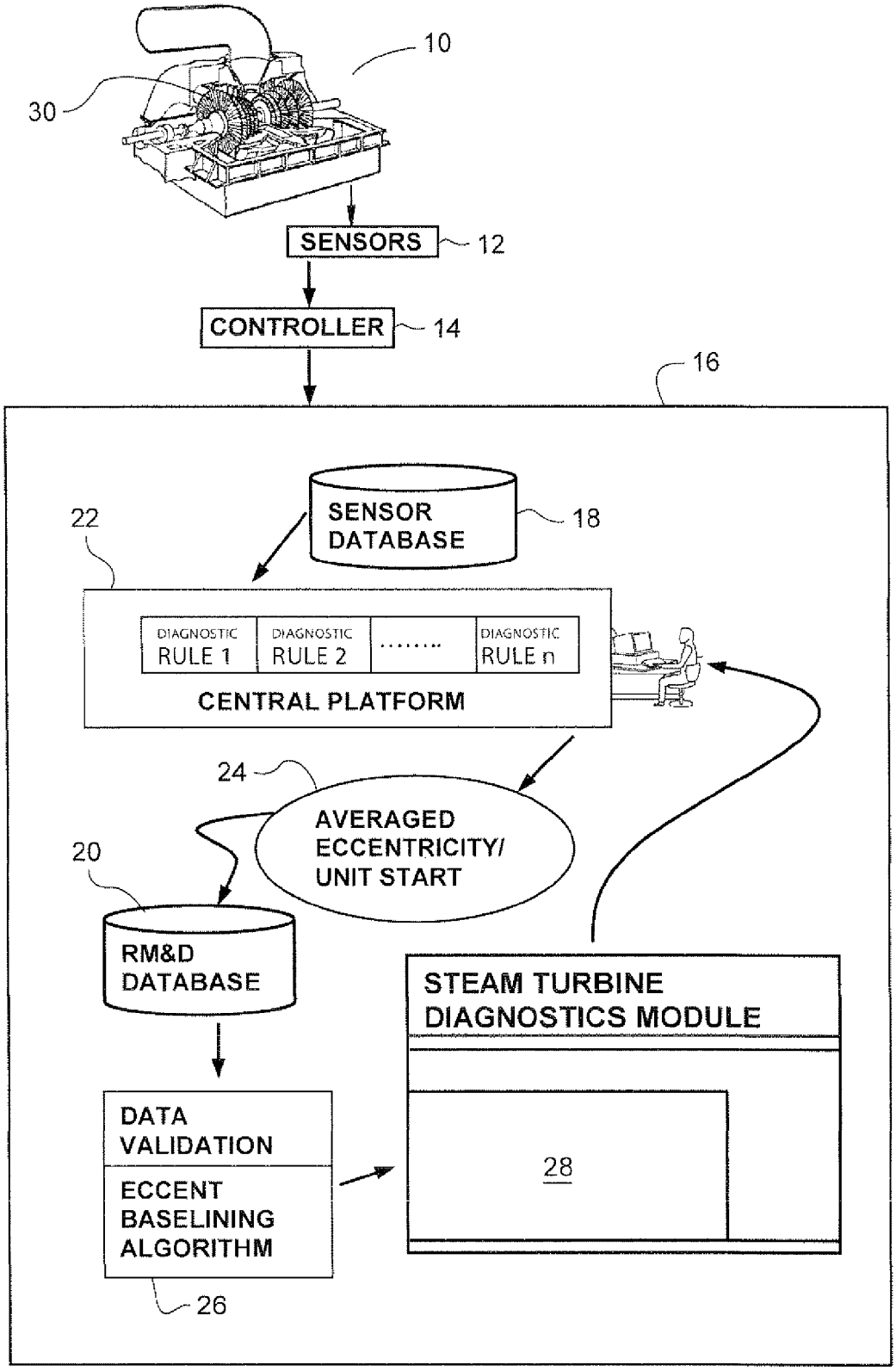
FIG. 1 is a schematic diagram of a system architecture for a system to monitor a steam turbine.

FIG. 1 is a schematic diagram of a steam turbine 10 monitored by a plurality of sensors 12, e.g., a displacement probes. Data from the sensors is received by a computer controller 14 for the steam turbine. The steam turbine 10, arrangement of the sensors 12, monitoring the turbine and turbine controller 14 are conventional and well-known components operating in a customary manner.

The sensors 12, e.g., displacement probes adjacent a turbine rotor 30, are commonly used for eccentricity monitoring and measurement on steam turbines. Displacement probes, data obtained from the sensors is routed through a local onsite monitor and stored on a central sensor database 18.

Data, e.g., eccentricity values and times at which the values are captured from sensor, is generated by the eccentricity monitoring sensors 12. The data may be relatively continuously captured by the sensors, such as every five minutes during the operation of the steam turbine. The controller 14 may store substantially all of the data from the sensors 12, at least for a predetermined period of time such as three months. Collecting substantially all sensor data can result in a large amount of eccentricity data being collected.

The data from the sensors is conveyed to the controller 14 and to a central computer system 16. Downloading data from the controller to the computer system 16 may be on a periodic basis, such as every day or every week. The computer system 16 may store the sensor data in a predefined table at a predefined location in the central sensor database 18. The data may be stored in the sensor database 18 for a time at least sufficient to filter the data to selected eccentricity data corresponding to particular events, e.g., turbine startup. It may not be necessary to store all sensor data, e.g., data not corresponding to a particular event, for long periods of time.

The central computer system 16 may be local, e.g., on-site, with the steam turbine or located remotely and accessing the controller through a wide-area network, such as the internet. The computer system 16 may include electronic memory that store databases and executable programs, input and output devices such as a communication device for receiving eccentricity data from the controller, a key board and monitor to interact with human operators, and printers to output reports regarding rotor eccentricities of the steam turbine. The central computer system 16 in general includes a data source, such as central database 18 that stores turbine sensor operational data. Eccentricity and other required measurement data from other steam turbines operating, such as other similar steam turbines operating in the field, may also be stored in the central database 18. In addition to sensor data, the database 18 may store data indicative of turbine start and stop operations. The information regarding start and/or stop operations may be to filter the sensor data and select sensor data corresponding to startup events. The sensor data from startup events may be used to determine baseline eccentricity values and to determine time windows of sensor data corresponding to startups. The eccentricity value for each startup is compared to the baseline value.

The databases in the computer system may include the sensor database 18 to store data from the sensors 12 and a database 20 to store monitoring and diagnosis (M&D) data. The data from the sensors may include information regarding the eccentricity of the rotor, e.g., displacement of the rotor and/or vibration of the rotor, and the time at which the eccentricity information was captured by the sensor. A processor (such as in the central platform) executes software programs 22, such as programs with diagnostic rules for sorting and filtering the eccentricity data stored in the sensor database 18. Data from the sensor database is analyzed by the processor which identifies data corresponding to start events of the steam turbine. When a startup event is identified, the eccentricity data from a period of time corresponding to the start event, such as one (1) hour prior to the identified start event, is analyzed to determine a stable, average eccentricity value. The remaining eccentricity data received from the sensors is not further used for eccentricity analysis. By limiting the amount of eccentricity data analyzed and/or stored, the volume of data to be reviewed is dramatically reduced.

By filtering the eccentricity data and using sensor data corresponding to only a single type of turbine event, e.g., start times, the eccentricity data can be more readily compared to determine variations in the rotor eccentricity over time. For example, data during turbine startup captures rotor eccentricity during low rotational speed operation and before steam heat applied to the turbine substantially influences the eccentricity of the rotor. During low speed rotor operation, the eccentricity of the rotor is relatively easy to measure by the sensors 12 and is not influenced by centrifugal forces that occur during high rotational speeds or by steam heat.

The computer system 16 may issue alarms and alerts if the change in baseline eccentricity is beyond predetermined limits. Other software programs executed by the processor may perform data analysis 24, e.g., averages of the sorted and/or filtered eccentricity data, wherein the results of the data analysis are stored in the M&D database 20. Additional executable software programs may validate 26 the results stored in the M&D database and present the vibration results to a steam turbine diagnostics module 28. The diagnostics module analyzes data from the steam turbine, including the results from the eccentricity data and reports the eccentricity condition of the steam turbine to the operator of the turbine. For example, the diagnostics module may determine a eccentricity baseline variation that indicates a eccentricity value that should be addressed by maintenance of the steam turbine.

The computer system 16 disclosed herein detects changes in the baseline eccentricity value throughout the entire operating life of a steam turbine. Knowledge of changes in baseline eccentricity in a steam turbine is helpful to identify the onset of a permanent bow in the rotor. Another module checks for changes in baseline eccentricity values of the turbine rotor. An alarm is raised if a significant shift is observed in the eccentricity baseline value. This alarm will be sent to an operator of the steam turbine such as through an email communication link between the computer system and the controller.

Eccentricity changes as the rotor transitions through various cycles of operation. There is a need to monitor the eccentricity in a steam turbine to track changes in the vibration characteristics of the turbine rotor. The monitoring is needed to detect when the eccentricity of the rotor becomes excessive.

Monitoring of eccentricity baseline variations is a parameter for assessing the steam turbine and determining when the maintenance or repair is needed. The baseline variation provides an indication of whether and when the rotor eccentricity becomes excessive, such as when eccentricity exceeds a threshold level of eccentricity. The computer system 16 provides a means for online detection of eccentricity baseline variations and assists in identifying steam turbines with degradation in their vibration behavior.

The computer system 16 generates an average eccentricity value prior to each steam turbine startup operation. The computer system determines a change in baseline eccentricity values for each of a series of startups over a period of time, such as over several years. The estimated changes in baseline eccentricity values may be plotted on a chart such as shown in FIG. 2.

Figure 2:
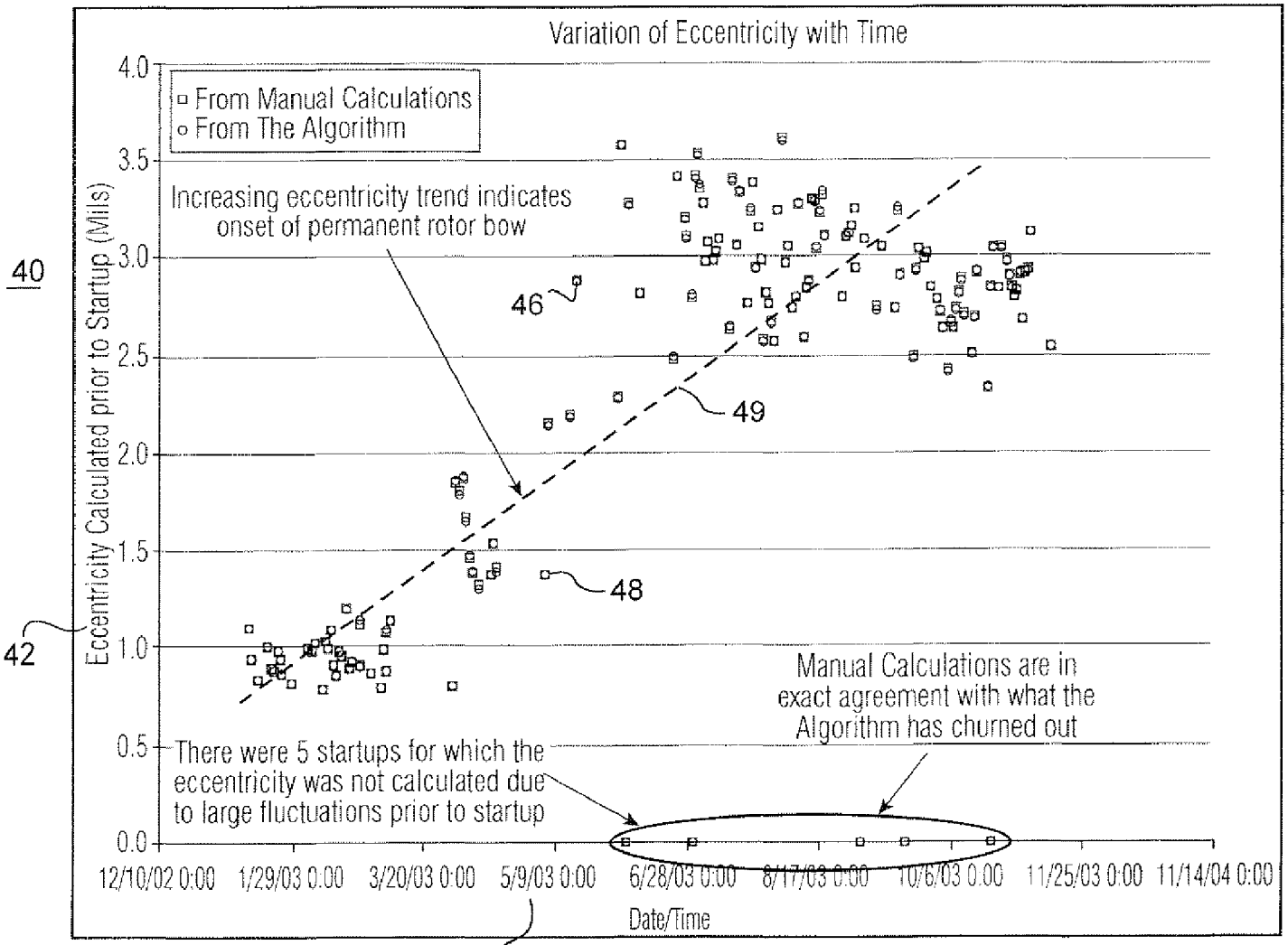
FIG. 2 is an exemplary chart showing rotor eccentricity trends based on eccentricity measurements taken at each turbine startup and plotted with respect to the dates on which the measurements were taken.

FIG. 2 is an exemplary chart 40 showing rotor eccentricity trends based on eccentricity values 42 corresponding to each turbine startup and plotted with respect to the dates 44 on which the measurements were taken. The eccentricity data is plotted on the chart by eccentricity measurement, e.g., in "mils" 0.001 inch (25.4 millimeters) and the corresponding startup time and date. The eccentricity measurements correspond to startup periods of the steam turbine for an extended period, such as two years. The eccentricity data plotted on chart 40 may represent rotor eccentricity at various starts during a period of years. The eccentricity measurements may be with respect to a baseline eccentricity. The eccentricity values plotted on the chart represent different values between a baseline eccentricity and another startup eccentricity value. The difference between the baseline eccentricity value and a startup eccentricity value is an indicator of how much additional bow is in the rotor from the baseline value.

The eccentricity measurements plotted on chart 40 may include eccentricity difference values 46 automatically determined by the computer system 16 using software algorithms applied to the eccentricity measurements and automatically plotted (see circles 46) on chart 40. Manually generated eccentricity measurements (indicated by stars/squares 48) may also be plotted on the chart 40, such as by manually entering the measurements and their associated start times in a user input device of the computer. The manually generated eccentricity measurements plotted in FIG. 2 correlate well to the measurements 46 automatically determined by the software algorithms of the computer system and disclosed herein. The strong correlation of manually and automatically determined measurements suggests that algorithms disclosed herein determine the eccentricity measurements with substantially the same accuracy as do the manually generated eccentricity measurements. The software algorithms may be used to automatically generate eccentricity values and difference from baseline values and thereby relieve the steam turbine technicians from manually generating eccentricity values. The dotted line 49 identifies a trend of the increase in eccentricity of the rotor over the period of years identified in chart 40.

To establish a baseline eccentricity value for a particular steam turbine, an average startup eccentricity algorithm identifies a first startup of the turbine from the sensor data stored in the sensor database 18, calculate a rotor eccentricity value using sensor data generated just before that first startup and applies the eccentricity value for the first startup as the baseline eccentricity representing the condition of a newly commissioned or a repaired rotor of a steam turbine. After establishing a baseline eccentricity value, the algorithm filters sensor data to identify and collect data corresponding to subsequent turbine startup events. The algorithm determines an eccentricity value for each startup event. The eccentricity value may be expressed as a difference between the eccentricity value determined for a subsequent startup event and the baseline eccentricity value.

If no startup events are present in the selected time period, e.g., if the turbine is on turning gear throughout a time period, the algorithm calculates an averaged eccentricity from the first data point available in the time period. The eccentricity value corresponding to the first data point may used as the baseline eccentricity value. For each period, e.g., a 15-day period, after the first data point, the algorithm calculates an average eccentricity and may calculate a difference between the average eccentricity value for the period and the value for the first data point. The eccentricity average values for each 15-day period may be plotted on a chart in a manner similar to that shown in FIG. 2.

In addition to calculating and plotting eccentricity values, the computer system 16 may monitor for high shifts in eccentricity baseline values. When an excessive shift in eccentricity is observed, an alarm may be reported via email, pager message or other communication to one or more steam turbine operators and technicians.

Figure 3:
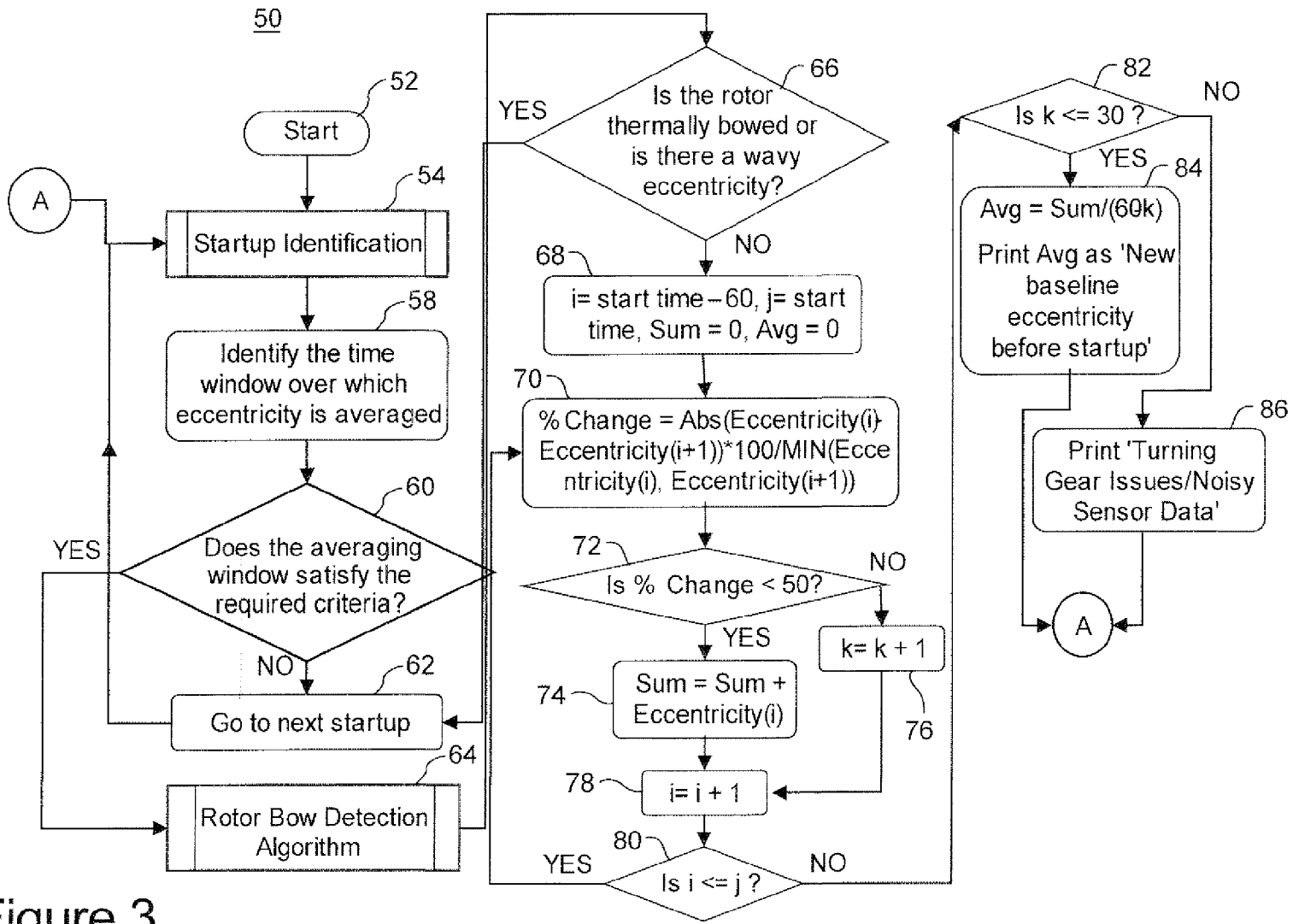
FIG. 3 is a flow chart of an exemplary algorithm to determine a stable, average rotor eccentricity at turbine startup.
Figure 4:
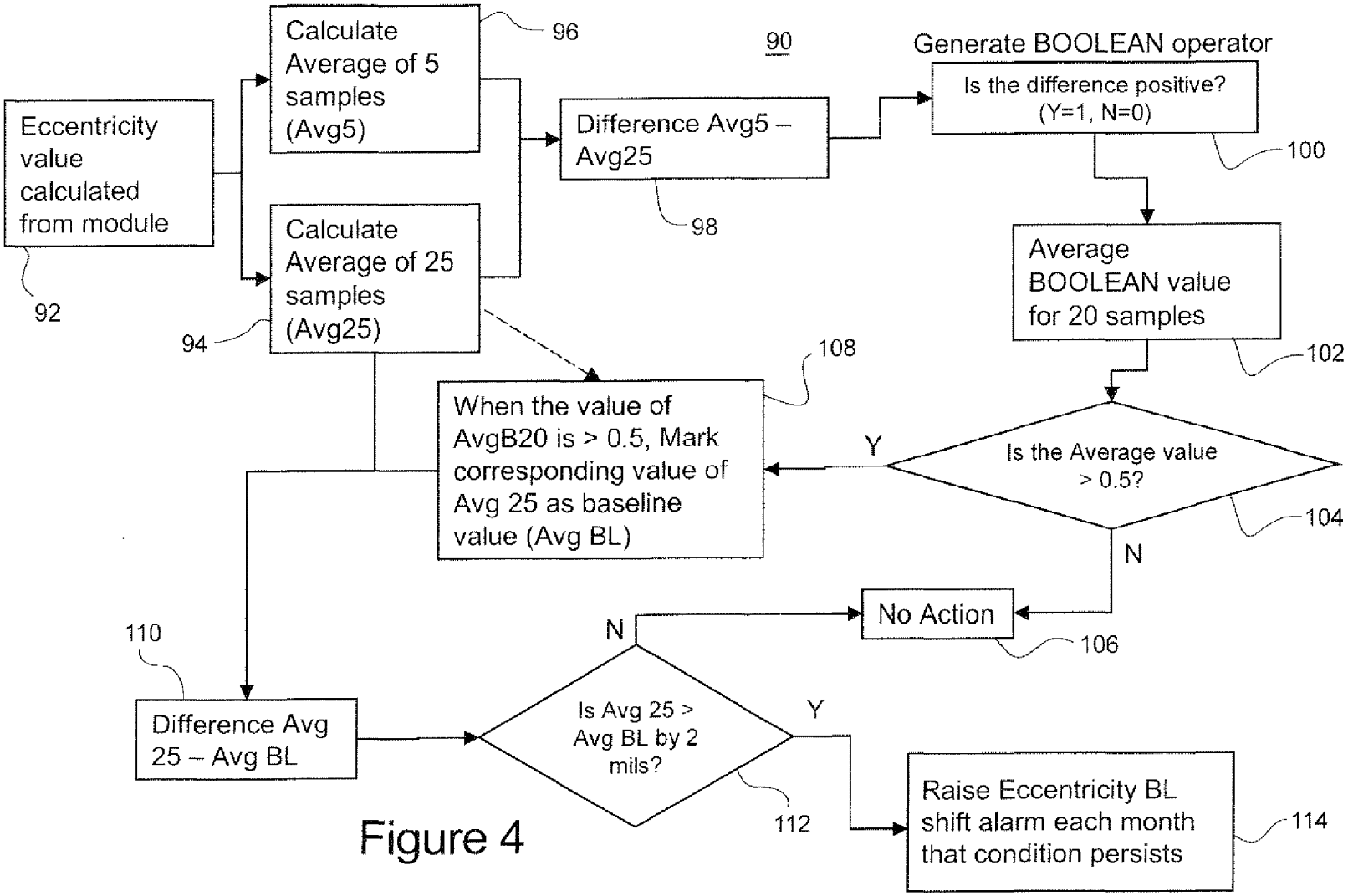
FIG. 4 is a flow chart of an exemplary algorithm to detect shifts in rotor eccentricity and issue warnings for excessive eccentricity shifts.

FIG. 3 is a flow chart of an exemplary rotor average startup eccentricity algorithm 50 to determine rotor eccentricity at each turbine startup. The algorithm 50 identifies a turbine start up event based on a review of sensor data stored in the database 18 (FIG. 1) and calculates averaged values of eccentricity during a valid operating window corresponding to the startup event. The eccentricity value is stored in a database 20 (FIG. 1) and is thereafter used for plotting charts (FIG. 2) and issuing alarms (FIG. 4). The algorithm 50 may be integrated into a calculation software module executed by the computer system 16 periodically, such as every 24 hours. The algorithm 50 may be applied to calculate the averaged eccentricities for startups events each day.

The algorithm starts (step 52) by identifying a steam turbine startup operation and optionally an immediately preceding turbine shutdown corresponding to the identified startup operation (step 54). The startup identification step 54 is performed on operational sensor and other data of the steam turbine acquired from the database 18.

The data may be analyzed for startup and shutdown operations using conventional startup/shutdown detection algorithms. By way of example, an algorithm to identify turbine shutdowns and a roll from a turning gear starting operation compares two conventional data signals. The first data signal is a logical signal that acquires values 0 and 1 depending on the status of turning gear engagement with a steam turbine rotor. At the beginning of a startup operation, the turning gear engages a rotor when the rotor is stopped and applies a turning torque to the rotor. The torque from the turning gear turns the rotor, albeit slowly. As steam is supplied to the turbine, the rotor accelerates and the turning gear is disengaged from the rotor as the rotor accelerates beyond a predetermined rotational speed. The second data signal indicates the rotational speed of the turbine, such as in revolution per minute (RPM). The startup/shutdown algorithm may identify the time at which the rotational speed of the turbine starts increasing continuously, such as beyond the turning gear speed (assumed to be 10 RPM). The logical signal from the first data signal may be used to identify the operating mode, e.g., a startup mode. The second data signal may be used to identify when the startup operation has achieved a predetermined rotational speed, such as beyond 10 RPM or 100 RPM. The startup identification step 54 may be used to identify a startup operation.

Once a valid startup has been identified in step 54, the algorithm 50 defines a predefined startup time period, e.g., a 60-minute time period prior to the identified startup (step 58). During the startup time period preceding the identified startup, the rotor turns slowly and the eccentricity sensors 12 generate signals indicative of the eccentricity in the rotor, before centrifugal forces and heat influence rotor bow. If a criteria for the time window is satisfied, the eccentricity data generated during the predefined startup time is averaged (step 60). This average is saved as the eccentricity value for the corresponding startup time period. If the criteria for the lime window is not satisfied in (step 62), the steps of identification of startup periods 54, determination of a startup time period 58 and determining 64 an average of the eccentricity values from that period is repeated for each startup operations in a defined time period, such as one to three years of steam turbine operation.

To determine an average eccentricity values for each startup operation, the algorithm 50 applies a rotor bow detection algorithm 64 which is detailed on the right-hand side of FIG. 3. The rotor bow detection algorithm 64 initially determines if a temporary rotor bow condition is present. A temporary bow may occur in a rotor slowly recovering from thermal bow events of a preceding shutdown. A temporary bow is not generally indicative of a permanent eccentricity in the rotor, and may be ignored in determining eccentricity trends. The rotor bow detection algorithm 64 may be applied (step 66) to ensure that temporary bow conditions are not used to generate the average eccentricity value plotted in chart 40.

The rotor bow detection algorithm 64, 66, determines if the rotor is thermally bowed by determining whether the rate of change of the bow measurement exceeds a predetermined level. For example, the rotor may be treated as thermally and temporarily bowed, if a filtered rate of bow change is greater than 0.03 mils/min for a 15 minute period. If a temporary bow is identified with respect to a particular startup operation, the algorithm discards that startup and automatically moves to the startup, in step 66 (yes condition).

The rotor bow detection algorithm 64, 66 identifies temporary eccentricities using a formula given below for calculating the change in rotor eccentricity during a startup operation. The algorithm 64 uses the eccentricity sensor data stored in the sensor database 18. The following equation calculates the eccentricity rate of change for thermal bow detection at each and every point of a selected startup period, e.g., a one-hour time period, of a turbine startup operation.

$$\text{ECC_ROC@Point'}X' = \frac{\frac{(ECC_X - ECC_{X-15})}{15} + \frac{(ECC_{X+1} - ECC_{X-14})}{15} + \frac{(ECC_{X+2} - ECC_{X-13})}{15} + \frac{(ECC_{X+3} - ECC_{X-12})}{15}}{4}$$

Where, point 'X' is in time on a 60-minute averaging time period; ECC_ROC is a filtered eccentricity rate of change value as given in the above equation, and ECC refers to the eccentricity values at each point in the 60-minute averaging time period. The rotor is considered to be thermally bowed if these filtered rate of change (ECC_ROC) is greater than 0.03 mils/min for 15 continuous minutes. If a thermal temporary bow is identified with respect to a particular startup, the algorithm discards that sensor data associated with that startup event and moves to a startup at step 66 (Yes condition).

If the rotor is determined to not be thermally bowed or there is no wavy eccentricity, then (in step 68), an averaging time period window, e.g., 60 minutes, is defined from zero (0) to j. The window is divided into increments of i, which correspond to eccentricity sensor data measurements in the time window. In step 70, the algorithm set forth below is applied to calculate a percent (%) change at a particular point in time (% ECC_ROC@X) in eccentricity between two subsequent data points in the time window.

$$\%\,\text{ECC_ROC@Point'}X' = \frac{|ECC_{X+1} - ECC_X| * 100}{\text{Minimum}(ECC_X, ECC_{X+1})}$$

Where, Point 'X' is a point in the 60 minute averaging window; % ECC_ROC is the percentage change in eccentricity between two successive data points in the averaging window, and ECC refers to the eccentricity values at each point in the 60-minute averaging window This percent (%) change calculation (step 70) is performed on each available data point in the time window. In step 72, if the percent (%) change for a data point is more than 50%, the corresponding eccentricity data point (X) is not considered (step 76) for eccentricity averaging, and is assumed to be associated with an eccentricity spike event. If the percent change is determined to be below 50% in step 72, the eccentricity value at the corresponding time increment (i) is added to the sum of eccentricity values in the time window. As indicated in step 80 (yes condition), the above steps (70 to 78) are repeated for each increment (i) in the time window and until the last increment is reached (i=j). When each eccentricity change (step 70) is determined and evaluated, (step 80, no condition) the sum (step 74) of all stable eccentricity values, e.g., values not a spike event, is used to determine an average eccentricity for the time period.

Once the rates of change is calculated for each eccentricity data point (i) in the averaging window, the algorithm counts (k) the number of data points for which the associated rate of change is greater than 50%, in step 76. If the number of such points is greater than a threshold level (step 82, no condition), such as half the time window (e.g., 30), the eccentricity data in the window is treated as too noisy. The corresponding startup event is not used for trending the rotor eccentricity because the eccentricity data in that event is discarded (step 86) as startups with noisy sensors data and the algorithm moves on to the next startup.

If the number of data points (k) is less than the threshold level (step 82 yes condition), then in step 84 an baseline average eccentricity value (Average_Eccnt) is determined using the sum (74) of stable eccentricity values and the following algorithm.

$$\text{AVERAGE_ECCENT} = \frac{\sum_{I=B}^{C} ECC_I,\ (\%\,\text{ECC_ROC}_I < 50\%)}{60 - N}$$

where, N is the number of data points for which % ECC_ROC is greater than 50%; % ECC_ROC is the percentage change in eccentricity between two successive data points in the 60 minute averaging window; 'B' is a data point 60 minutes prior to the unit startup time, and 'C' is a data point which corresponds to the unit startup time. The baseline average eccentricity value (AVG_ACCENT) for the corresponding startup condition is stored in the M&D database 20 (FIG. 1).

The steps described in steps 54 to 84 may be performed for each startup operation for which eccentricity sensor data is available. In situations where the steam turbine is not operational for a long period of time following a shutdown, the same calculations are carried out every 15 days starting from the most recent shutdown. The results of these calculations are stored as the baseline eccentricity value for each startup condition in the M&D database 20.

After the algorithm 50 calculates the baseline eccentricity for every startup available for a turbine, the results of these calculations are used to determine the shift in baseline eccentricity. FIG. 4 is a flow chart of an eccentricity shift algorithm 90 that detects a shift in baseline eccentricity values and automatically reports, e.g., sends an email, significant changes in baseline eccentricity values. Eccentricity baseline increases may be directly related to the vibration behavior of a steam turbine. Eccentricity baseline values provide a means for monitoring the vibration behavior of a steam turbine. Increases in eccentricity baseline values can indicate an increase in rub events, e.g., rubbing between rotating and stationary components. Rub events and changes in the vibration behavior of a steam turbine may be detected by monitoring changes in baseline eccentricity values. The eccentricity baseline shift algorithm 90 detects changes in baseline eccentricity values and generates reports to inform steam turbine technicians and other personnel responsible for the steam turbine. Further, the eccentricity shift algorithm issues alarms indicative of the degree of eccentricity base line shifting.

The eccentricity baseline shift algorithm 90 uses averaged eccentricity data, in step 92, calculated by the average startup eccentricity algorithm 50 and stored in the M&D database 20.

In step 94, a long term average eccentricity value is determined from a series of eccentricity values at startup conditions, such as the most recent 25 eccentricity values (Avg 25). An average of 25 eccentricity values is taken to minimize scattering effects in eccentricity values and to establish a trend of eccentricity over a relatively long period. In step 96, an average of current eccentricity values is determined for a reduced number of sequential startup conditions, such as an average of the eccentricity values for the most recent five startup conditions (Avg5). The average current eccentricity for the reduced number of startup conditions is indicative of current changes of the eccentricity value. The average of current eccentricity values is predetermined for each successive startup condition.

In step 98, a difference is determined between the current average value (AVG5) in eccentricity values (step 96) and the long term eccentricity values (step 94). A positive difference indicates that the eccentricity of the rotor is increasing. In step 100, a Boolean operation is performed to identify whether the difference (Avg 5 minus Avg 25) is positive (1 output) or negative (0). If there is a positive difference, a determination is made if the current increases for a predetermined number of successive startup events (step 96). An average is taken of the Boolean operation outputs (1 or 0) for a sequence of startup events, for example, of twenty (20), in step 102. If the average Boolean value is less than 0.5 for twenty startup events, in step 104, then no automatic report is generated (step 106) by the eccentricity baseline shift algorithm 90. If the average Boolean output is greater than 0.5 for twenty startup events (step 104), the corresponding AVG 25 baseline value from step 94 is marked as a current reference baseline eccentricity value in step 108. As step 94 is repeated for evaluation of eccentricities of subsequent startup operations, the current AVG 25 eccentricity value generated by that step may shift from the baseline value marked in step 108. If the difference (step 110) between the AVG 25 baseline value (step 108) and the current AVG 25 eccentricity value becomes greater than a predetermined amount, e.g., 2 mils, (step 112) an alarm is issued that reports an eccentricity baseline (BL) shift in step 114. The alarm may be emails sent to the steam turbine technician and other individuals responsible for the steam turbine. No action (Step 106) is taken if the AVG 25 eccentricity value is less than the predetermined amount.

The system described herein provides several technical effects including the capability to accurately calculate baseline values of eccentricity and thus overall unit health and vibration behavior especially during steam turbine transients. The system provides an on-line solution for identifying turbines with permanent and offers an overall picture of rotor eccentricity changes. This information allows steam turbine operators to fine-tune steam turbine operation and maintenance. The availability and reliability of rotor eccentricity data also reduces the maintenance & operating cost of steam turbines. The algorithms used in the system described herein has features to detect eccentricity decay following thermal bow and wavy/spiked eccentricity patterns, prior to startups. These abnormal data points are not used in calculations as they might skew the output of the system.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to determine eccentricity of a rotor in a turbine comprising:

collecting sensor data of rotor eccentricity for a plurality of startup operations;

establishing a baseline eccentricity value using the sensor data corresponding to a selected startup operation;

determining an eccentricity value using the filtered sensor data for each of a plurality of startup operations subsequent to the selected startup operation;

determining a rotor eccentricity difference between the baseline eccentricity value and each of the eccentricity values for the plurality of startup operations subsequent to the selected startup operation, and reporting a rotor eccentricity condition based on the rotor eccentricity difference.

2. The method as in claim 1 further comprising filtering the sensor data to select sensor data corresponding to startup operations and using only the selected sensor data to determine the eccentricity values.

3. The method as in claim 1 wherein reporting the rotor eccentricity condition includes reporting a trend of the rotor eccentricity differences for a period of time of at least one year.

4. The method as in claim 1 further comprising excluding from the determination of the eccentricity value sensor data having a rate of change greater than a predetermined limit during a startup period.

5. The method as in claim 1 wherein determining the eccentricity value includes determining an average of the sensor data for a startup period, wherein the period corresponds to low speed rotor operation at startup.

6. The method as in claim 5 wherein the low speed rotor operation is below 100 revolutions per minute.

7. The method as in claim 1 wherein reporting the rotor eccentricity condition includes comparing a long term average of eccentricity values for a plurality of startup operations over a predetermined long period of time to a current average of eccentricity values for a predetermined number of most recent startup operations.

8. The method as in claim 1 wherein the turbine is a steam turbine.

9. The method as in claim 1 further comprising excluding from the determination of rotor eccentricity differences the eccentricity value for a startup operation during which startup operation a rate of change of rotor eccentricity exceeds a predetermined threshold rate of rotor eccentricity change.

10. The method as in claim 9 further comprising determining the rate of change of rotor eccentricity during one of said startup operation as a function of a plurality of rotor eccentricity values determined during the one of said startup operation.

11. The method of claim 9 wherein predetermined threshold rate of rotor eccentricity change is greater than 0.03 mils/min for 15 continuous minutes.

12. A method to determine eccentricity of a rotor in a turbine comprising:

collecting sensor data of rotor eccentricity for a time period corresponding to a variety of turbine operations;

filtering the sensor data to extract sensor data corresponding to turbine startup operations;

establishing a baseline eccentricity value using the filtered sensor data corresponding to a selected startup operation;

determining an eccentricity value using the filtered sensor data for each of a plurality of startup operations subsequent to the selected startup operation;

determining a rotor eccentricity difference between the baseline eccentricity value and each of the eccentricity values for the plurality of startup operations subsequent to the selected startup operation, and reporting a rotor eccentricity condition based on the rotor eccentricity difference.

13. The method as in claim 12 wherein reporting the rotor eccentricity condition includes reporting a trend of the rotor eccentricity differences for a period of time of at least one year.

14. The method as in claim 12 wherein determining the eccentricity value includes determining an average of the sensor data for a startup period, wherein the period corresponds to low speed rotor operation at startup.

15. The method as in claim 14 wherein the low speed rotor operation is below 100 revolutions per minute.

16. The method as in claim 14 wherein reporting the rotor eccentricity condition includes comparing a long term average of eccentricity values for a plurality of startup operations over a predetermined long period of time to a current average of eccentricity values for a predetermined number of most recent startup operations.

17. The method as in claim 14 further comprising excluding from the determination of rotor eccentricity differences the eccentricity value for a startup operation during which startup operation a rate of change of rotor eccentricity exceeds a predetermined threshold rate of rotor eccentricity change.

18. The method as in claim 17 further comprising determining the rate of change of rotor eccentricity during one of said startup operation as a function of a plurality of rotor eccentricity values determined during the one of said startup operation.

19. A system to determine eccentricity of a rotor in a turbine comprising:

a rotor eccentricity sensor monitoring rotor eccentricity and generating rotor eccentricity data;

a computer system including:

a database storing the rotor eccentricity data for a period corresponding to a variety of turbine operations;

a data filter extracting rotor eccentricity data corresponding to turbine startup operations from the rotor eccentricity data and generating filtered sensor data;

an algorithm establishing a baseline eccentricity value using the filtered sensor data corresponding to a selected startup operation;

an algorithm establishing an eccentricity value using the filtered sensor data for each of a plurality of startup operations subsequent to the selected startup operation;

an algorithm determining a rotor eccentricity difference between the baseline eccentricity value and each of the eccentricity values for the plurality of startup operations subsequent to the selected startup operation, and an report generator to issue reports of a rotor eccentricity condition based on the rotor eccentricity difference.

20. The system as in claim 19 wherein the rotor eccentricity sensor is a displacement sensor.

* * * * *

UNITED STATES PATENT AND TRADEMARK OFFICE

CERTIFICATE OF CORRECTION

PATENT NO. : 7,742,881 B2
APPLICATION NO. : 11/832755
DATED : June 22, 2010
INVENTOR(S) : Muralidharan et al.

It is certified that error appears in the above-identified patent and that said Letters Patent is hereby corrected as shown below:

At column 6 lines 49-50, delete "lime window" and insert --time window--

Signed and Sealed this

Thirty-first Day of August, 2010

David J. Kappos

David J. Kappos
*Director of the United States Patent and Trademark Office*